US008841825B2

(12) United States Patent
Yamanaka

(10) Patent No.: US 8,841,825 B2
(45) Date of Patent: Sep. 23, 2014

(54) SPARK PLUG DESIGNED TO INCREASE SERVICE LIFE THEREOF

(75) Inventor: Kouji Yamanaka, Nishio (JP)

(73) Assignee: Denso Corporation, Kariya (JP)

( * ) Notice: Subject to any disclaimer, the term of this patent is extended or adjusted under 35 U.S.C. 154(b) by 32 days.

(21) Appl. No.: 13/568,495

(22) Filed: Aug. 7, 2012

(65) Prior Publication Data

US 2013/0038197 A1 Feb. 14, 2013

(30) Foreign Application Priority Data

Aug. 8, 2011 (JP) ..... 2011-173090
Apr. 6, 2012 (JP) ..... 2012-087382

(51) Int. Cl.
*H01T 13/20* (2006.01)
*H01T 13/32* (2006.01)
*H01T 13/50* (2006.01)

(52) U.S. Cl.
CPC ..... *H01T 13/50* (2013.01); *H01T 13/20* (2013.01); *H01T 13/32* (2013.01)
USPC ..... 313/141; 313/143

(58) Field of Classification Search
CPC ..... H01T 13/14; H01T 13/16; H01T 13/20; H01T 13/32; H01T 13/38; H01T 13/46; H01T 13/50; H01T 13/467
USPC ..... 313/118–145
See application file for complete search history.

(56) References Cited

U.S. PATENT DOCUMENTS

| | | | | |
|---|---|---|---|---|
| 4,983,877 | A * | 1/1991 | Kashiwara et al. | 313/140 |
| 6,215,233 | B1 | 4/2001 | Matsubara | |
| 6,307,307 | B1 * | 10/2001 | Kanao | 313/142 |
| 2005/0174025 | A1 * | 8/2005 | Okamoto | 313/143 |

FOREIGN PATENT DOCUMENTS

| | | |
|---|---|---|
| JP | H11-219771 | 8/1999 |

* cited by examiner

*Primary Examiner* — Andrew Coughlin
(74) *Attorney, Agent, or Firm* — Nixon & Vanderhye PC

(57) ABSTRACT

A spark plug for an internal combustion engine is provided which is equipped with an inward top end protrusion. The inward top end protrusion extends inwardly from a top end of a cylindrical housing within which a porcelain insulator is disposed. The porcelain insulator has a center electrode disposed therein. The inward top end protrusion is at least partially located to be closer to the top of the spark plug than a top end of the porcelain insulator is in an axial direction of the spark plug. This enhances the strength of an electric field surrounding the center electrode, which facilitates the ease with which an electron is emitted by the center electrode and thus permits an initial required voltage at the spark plug to be decreased, thereby resulting in an increase in service life of the spark plug.

6 Claims, 15 Drawing Sheets

SPARK PLUG DESIGNED TO INCREASE SERVICE LIFE THEREOF

CROSS REFERENCE TO RELATED DOCUMENT

The present application claims the benefit of priority of Japanese Patent Application Nos. 2011-173090 filed on Aug. 8, 2011 and 2012-87382 filed on Apr. 6, 2012, the disclosures of which are incorporated herein by reference.

BACKGROUND OF THE INVENTION

1. Technical Field

This disclosure relates generally to an improved structure of a spark plug which may be used in internal combustion engines for automotive vehicles and is designed to increase the service life thereof.

2. Background Art

Japanese Patent First Publication No. 11-219771 discloses a spark plug equipped with a center electrode and a ground electrode which defines a spark gap therebetween to produce a sequence of sparks to ignite an air-fuel mixture admitted into a combustion chamber of an internal combustion engine.

The service life of such a type of spark plug usually depends upon a rise in required voltage resulting from an increase in size of the spark gap. Specifically, the size of the spark gap is increased gradually by spark discharge events during the operation of the spark plug, which leads to an increase in voltage required to be developed between the center electrode and the ground electrode for producing the spark. When such a require voltage exceeds an upper limit, the spark plug will reach the end of its life span.

There have been proposed various measures to shape the structure of the center electrode or the ground electrode to decrease an initial spark gap in order to minimize the required voltage.

The decrease in initial spark gap, however, results in an increase in possibility that an initial flame of the air-fuel mixture is quenched, which leads to a failure in igniting the mixture.

Use of material that exhibits a high degree of wear resistance in making a tip of the center electrode or a portion of the ground electrode which faces the center electrode may also be proposed in order to minimize the increase in size of the spark gap. This, however, results in an increase in overall production cost of the spark plug. Chips provided on the top of the center electrode and/or the surface of the ground electrode which faces the center electrode may be increased in diameter to retard the increase in size of the spark gap. This, however, also results in an increase in overall production cost of the spark plug and in a deterioration of ignitability of the mixture in the engine. It further causes a drop in strength of an electric field around the chips, thus increasing the required voltage.

Conversely, an increase in strength of an electric field in the spark gap and enhancement in ignitability of the mixture in the combustion chamber of the engine may be achieved by decreasing the diameter of the chips. This, however, accelerates the wear of the chips, that is, the increase in size of the spark gap, which will lead to a decrease in service life of the spark plug.

It is, therefore, difficult to shape the structure of the center electrode or the ground electrode to prolong the life of the spark plug.

The spark plug, as taught in the above publication, has a protruding annular edge which is formed on an inner surface of a hollow cylindrical housing to define an auxiliary air gap between itself and the center electrode. In the auxiliary air gap, a spark is created to remove carbon deposits on a porcelain insulator of the spark plug. The annular edge faces an outer periphery of the porcelain insulator and is located away from the spark gap toward a base end of the spark plug, thus resulting in a difficulty in increasing the strength of the electric field in the spark gap and decreasing the required voltage which are needed to prolong the service life of the spark plug.

SUMMARY

It is therefore an object to provide a structure of a spark plug for use in internal combustion engines which is designed to ensure a prolonged service life thereof without modifying structures of a center and a ground electrode.

According to one aspect of an embodiment, there is provided a spark plug which may be employed in igniting an air-fuel mixture in automotive engines. The spark plug includes: (a) a hollow cylindrical housing with a top end facing a top of the spark plug; (b) a cylindrical porcelain insulator which is retained in the cylindrical housing; (c) a center electrode which is retained in the porcelain insulator with a top thereof exposed outside a top end of the porcelain insulator; (d) a ground electrode which is joined to the cylindrical housing so as to form a spark gap between itself and the top of the center electrode; and (e) an inward top end protrusion which extends inwardly from the top end of the cylindrical housing. The inward top end protrusion is at least partially located to be closer to the top of the spark plug than the top end of the porcelain insulator is in an axial direction of the spark plug. This enhances the strength of an electric field surrounding the center electrode, which facilitates the ease with which electrons are emitted by the center electrode and thus permits an initial required voltage at the spark plug to be decreased, in other words, the service life of the spark plug that is the length of time until the required voltage exceeds an upper limit as a function of an increase in size of the spark gap can be prolonged.

The increase in service life of the spark plug is, as apparent from the above, achieved by shaping the configuration of the cylindrical housing without modifying the structure of either of the center electrode or the ground electrode, thus ensuring the stability in operation of the spark plug for a long period of time without an increase in production cost resulting from the modification of the center electrode or the ground electrode and a deterioration in ignitability of the air-fuel mixture in the engine.

In the preferred mode of the invention, a distance L between the inward top end protrusion and the center electrode and a size G of the spark gap in the axial direction of the spark plug are so selected as to meet a relation of $G<L$. This avoids the creation of sparks between the inward top end protrusion and the center electrode, thus ensuring the stability in developing sparks in the spark gap to ignite fuel in the engine.

It is preferable that the distance L and the size G of the spark gap are so selected as to satisfy a relation of $G+0.5\ \text{mm}<L$. This avoids the discharge of sparks to the inward top end protrusion when the spark gap is increased with time, thus ensuring the ignitability of the fuel in the engine.

The top of the center electrode may extend outside the top end of the cylindrical housing toward the top of the spark plug. This permits the inward top end protrusion to be increased in area thereof facing the periphery of the center electrode to promote the strength of an electric field surrounding the center electrode, thus allowing the required voltage at the spark plug to be decreased and lowering the flame quenching property of the cylindrical housing to improve the ignition ability of the spark plug.

The distance L between the inward top end protrusion and the center electrode may be set greater than or equal to H over root three where H is a distance between the top of the center electrode and the top end of the cylindrical housing in the axial direction of the spark plug. This reduces the required voltage at the spark plug.

A thickness t of an inner top end of the inward top end protrusion, as defined in the axial direction of the spark plug, and a diameter D of the top of the center electrode may be so provided as to meet a relation of $t \leq D$. This also reduces the required voltage at the spark plug.

The inward top end protrusion is formed over a range of 90° or more in a circumferential direction of the spark plug. This permits the required voltage at the spark plug to drop greatly.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 21(*b*) is a top view which illustrates another type of a test sample of a spark plug of the second embodiment.

DESCRIPTION OF THE PREFERRED EMBODIMENTS

Figure 1:
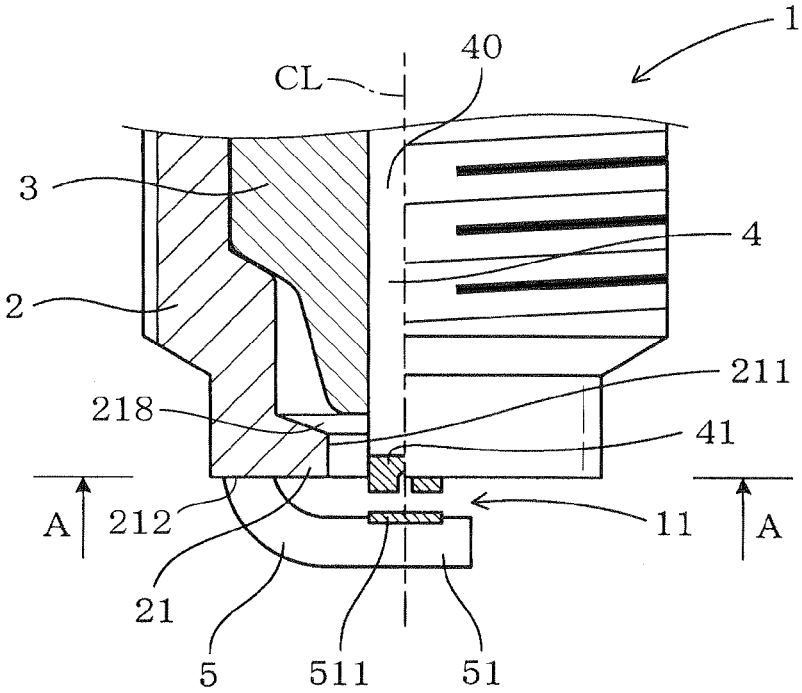
FIG. 1 is a partially longitudinal sectional view which shows a spark plug according to the first embodiment.

Referring to the drawings, wherein like reference numbers refer to like parts in several views, particularly to FIGS. 1 to 5, there is shown a spark plug 1 according to the first embodiment which is to be installed in an internal combustion engine mounted in, for example, automotive vehicles, motorcycles, co-generation systems, or gas feed pumps. The spark plug 1 works to produce a sequence of electric sparks to ignite an air/fuel mixture introduced into the internal combustion engine. The spark plug 1 is equipped with a hollow cylindrical metal shell 2 (also called a metal case or housing), a cylindrical porcelain insulator 3, a center electrode 4, and a ground electrode 5. The porcelain insulator 3 is retained in the metal shell 2. The center electrode 4 is retained inside the porcelain insulator 3 with a top end protruding from an end of the porcelain insulator 3. The ground electrode 5 is of substantially L-shape and joined to the metal shell 2 to form a spark gap (also called an air gap) 11 between itself and the center electrode 4.

The metal shell 2 is, as clearly illustrated in FIG. 1, equipped with an inward top end protrusion 21 defined by an annular ridge extending on a top end portion of an inner wall of the metal shell 2.

The inward top end protrusion 21 is at least partially located to be closer to the top (or head) of the spark plug 1 (i.e., the top of the ground electrode 5 than the top of the porcelain insulator 3 is in a longitudinal or axial direction of the spark plug 1. In other words, the inward top end protrusion 21 lies at least partly between the top end of the porcelain insulator 3 and the top end of the spark plug 1. In the illustrated example, the whole of the inward top end protrusion 21 is located outside the top of the porcelain insulator 3 in the axial direction of the spark plug 1. The inward top end protrusion 21 has an inner surface which faces an outer periphery (i.e., a side surface) of the center electrode 4 at a location outside the porcelain insulator 3 in the axial direction of the spark plug 1.

Figure 3:
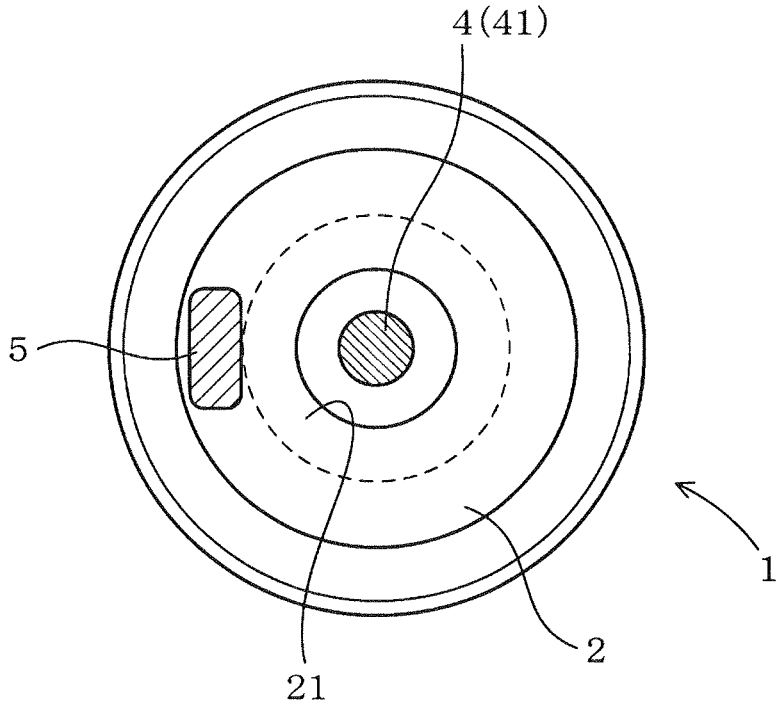
FIG. 3 is a partially traverse sectional view, as taken along the line A-A in FIG. 1.

The inward top end protrusion 21, as can be seen from FIG. 3, extend continuously over the entire inner circumference of the top end of the metal shell 2. The inward height of the inward top end protrusion 21, that is, the distance between the inner surface of the metal shell 2 and the inner end of the inward top end protrusion 21 is constant over the inner circumference of the metal shell 2. In other words, the interval between the inner top end of the inward top end protrusion 21 and the outer periphery of the center electrode 4 in a radial direction of the spark plug 1 is constant.

The spark plug 1 of this embodiment is, as described above, designed for use in an internal combustion engine mounted in, for example, automotive vehicles, motorcycles, co-generation systems, or gas feed pumps.

Figure 4:
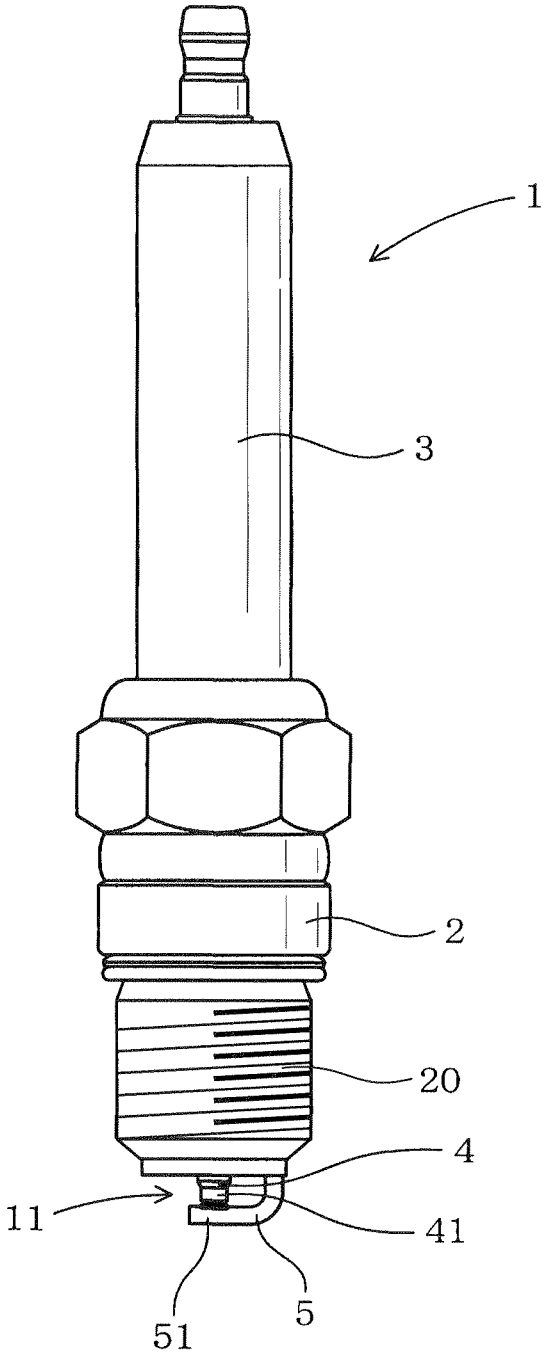
FIG. 4 is a side view which shows the spark plug of FIG. 1.

The spark plug 1, as illustrated in FIG. 4, has a thread 20 formed on the outer periphery of the metal shell 2. The thread 20 is screwed into a wall of a combustion chamber (not shown) of the internal combustion engine to mount the spark plug 1 in the engine. The metal shell 2 is formed by substantially a hollow cylinder made of, for example, a carbon steel.

The porcelain insulator 3 is, as illustrated in FIG. 1, disposed inside the metal shell 2. The porcelain insulator 3 is formed by a cylindrical member made of ceramics such as alumina. Within the porcelain insulator 3, the center electrode 4 is disposed. The center electrode 4 consists of a cylindrical main body 40 made of a Ni (nickel) alloy and a noble metal chip 41 affixed or welded to the top of the main body 40. The noble metal chip 41 is formed by a cylindrical member made from, for example, Ir (iridium), Rh (rhodium), or Ru (ruthenium). The noble metal chip 41 at least projects from the top end of the porcelain insulator 3 in the axial direction of the spark plug 1. The noble metal chip 41 also at least partly projects from the top end of the metal shell 2 in the axial direction of the spark plug 1. The noble metal chip 41 has a groove from in a top end thereof.

Figure 2:
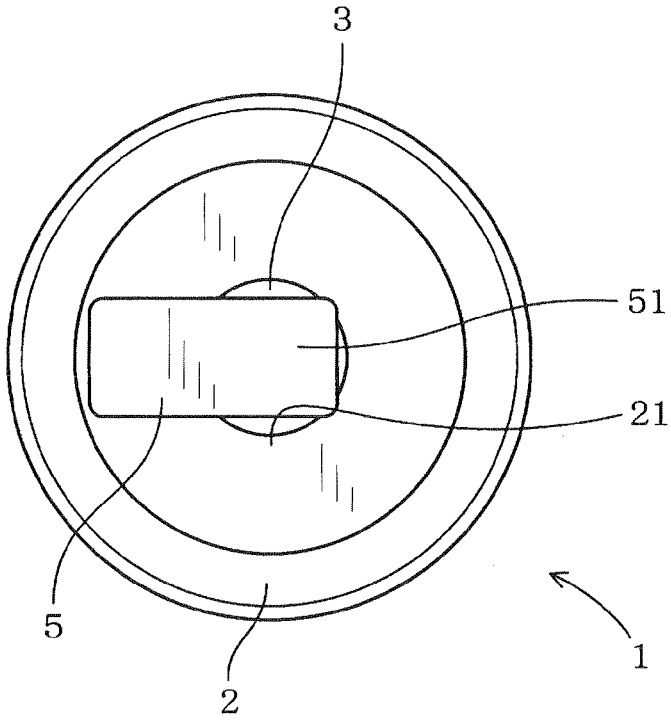
FIG. 2 is a top view of FIG. 1.

The ground electrode 5 is joined or welded at an end thereof to the top end surface of the metal shell 2. The ground electrode 5, as clearly illustrated in FIGS. 1 and 2, is bent to have a top end portion as a center electrode-facing portion 51 which faces the noble metal chip 41 of the center electrode 4. The center electrode-facing portion 51 has embedded therein a noble metal chip 511 which faces the noble metal chip 41 of the center electrode 4. The noble metal chip 511 is made from Ir (iridium), Rh (rhodium), or Ru (ruthenium). The noble metal chip 511 of the ground electrode 5 and the noble metal chip 41 of the center electrode 4 define the spark gap 11 therebetween.

Figure 5:
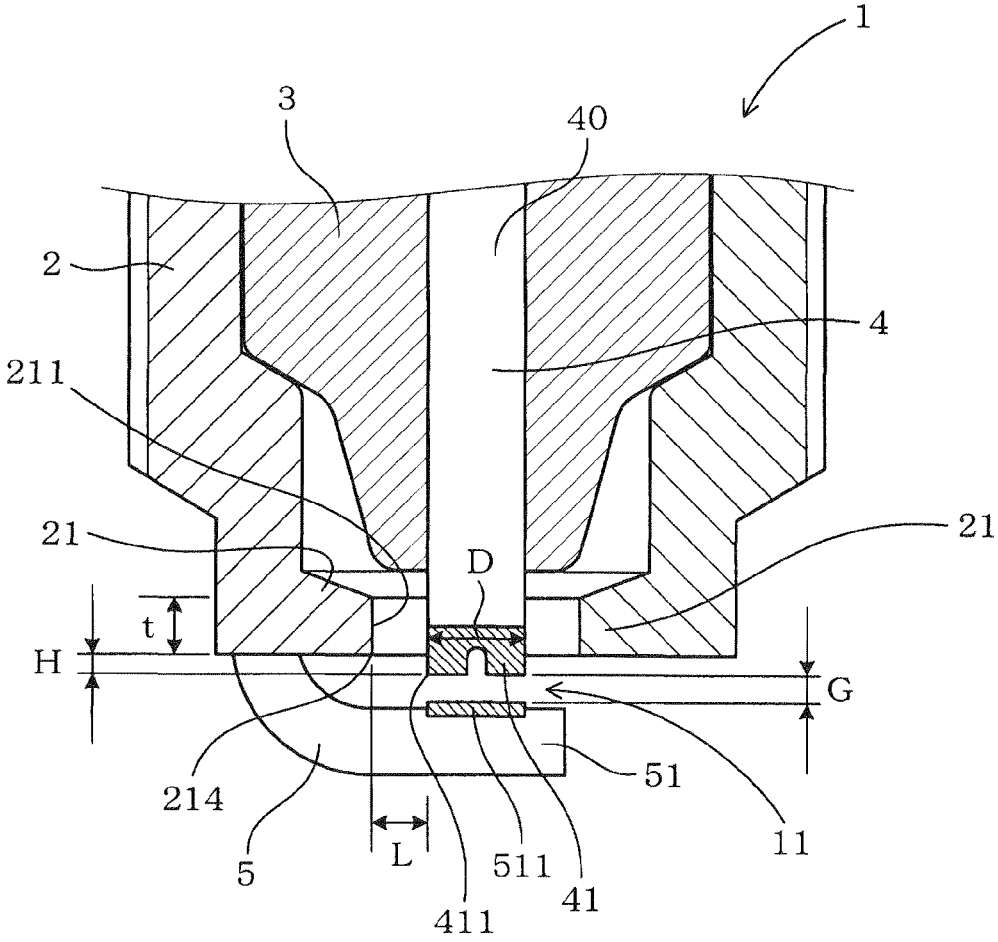
FIG. 5 is a partially longitudinal sectional view which shows dimensions of an inward top end protrusion of the spark plug of FIG. 1.

As illustrated in FIG. 5, the distance (i.e., a minimum distance) L between the inward top end protrusion 21 and the center electrode 4 and the size G of the spark gap 11 (i.e., the distance between opposed surfaces of the noble metal chips 41 and 511 in the axial direction of the spark plug 1) are so selected as to meet a relation of $G<L$. In this embodiment, a relation of G 0.5 mm<L is met.

The distance H between the top end of the center electrode 4 and the top end of the metal shell 2 in the axial direction of the spark plug 1 is so selected as to meet a relation of $L \geq H/\sqrt{3}$.

The inward top end protrusion 21 has an annular inner top end 211. The inner top end 211 is defined by a flat surface extending parallel to the axial direction of the spark plug 1. The thickness t of the inner top end 211 in the axial direction of the spark plug 1 (i.e., the width of the flat surface of the inner top end 211 extending in the circumferential direction of the spark plug 1) and the diameter D of the top end of the center electrode 4 (i.e., the noble metal chip 41) are so selected as to meet a relation of $t \leq D$.

The inward top end protrusion 21 has a top end surface 212 which extends perpendicular to the axis (i.e., the length) of the spark plug 1 and defines the top end of the metal shell 2 which is to be exposed to the combustion chamber of the engine when the spark plug 1 is mounted in the engine. The inward top end protrusion 21 also has an annular slant base end surface 218 which is located at an opposite side of the top end surface 212 in the axial direction of the spark plug 1. The base end surface 218 faces the base end (i.e., an upper end, as viewed in FIG. 4) of the spark plug 1 and tapers inwardly so that it may approach the top end of the spark plug 1 as is closer to the center electrode 4.

The ground electrode 5 is joined at the base end thereof to the top end surface 212 of the metal shell 2 on the outside of a portion of the inner wall of the metal shell 2 from which the inward top end protrusion 21 extends inwardly of the metal shell 2.

The operation and beneficial effects of the spark plug 1 will be described below.

The metal shell 2 of the spark plug 1 is, as described above, equipped with the inward top end protrusion 21 which is at least partially located to be closer to the top end of the spark plug 1 (i.e., the top of the ground electrode 5 than the top end of the porcelain insulator 3 is in the axial direction of the spark plug 1. The inward top end protrusion 21 at least partly extends from the inner wall of the metal shell 2 inwardly toward the center electrode 4, thereby enhancing the strength of an electric field surrounding the center electrode 4. This facilitates the ease with which electrons are emitted by the center electrode 4 and thus permits an initial required voltage at the spark plug 1 to be decreased, in other words, the service life of the spark plug 1 that is the length of time until the required voltage exceeds an upper limit as a function of an increase in size of the spark gap 11 to be prolonged.

The spark plug 1 of this embodiment is, as apparent from the above discussion, designed to shape the configuration of the metal shell 2 in order to extend the length of life thereof without modifying the structure of either of the center electrode 4 or the ground electrode 5, in other words, engineered to ensure the increased service life without an increase in production cost resulting from the modification of the center electrode 4 or the ground electrode 5 and a deterioration in ignitability of the air-fuel mixture in the engine.

The spark plug 1 is designed to have the interval or distance L between the inner top end 211 of the inward top end protrusion 21 and the periphery of the center electrode 4 which is greater than the size G of the spark gap 11 (i.e., $G<L$). This avoids the creation of sparks between the inward top end protrusion 21 and the center electrode 4, thus ensuring the stability in developing sparks in the spark gap 11 to ignite the air-fuel mixture in the engine.

The distance L and the size G of the spark gap 11 are preferably selected to satisfy a relation of G+0.5 mm<L. This avoids the discharge of sparks to the inward top end protrusion 21 when the spark gap 11 is increased with time, thus ensuring the ignitability of the air-fuel mixture in the engine.

The head of the center electrode 4 projects from the top end surface 212 of the metal shell 2, thus permitting the inward top end protrusion 21 to be increased in area thereof facing the periphery of the center electrode 4 to promote the strength of an electric field surrounding the center electrode 4. This allows the required voltage at the spark plug 1 to be decreased and lowers the flame quenching property of the metal shell 2 to improve the ignition ability of the spark plug 1.

The distance L between the inner top end 211 of the inward top end protrusion 21 and the periphery of the center electrode 4 is set greater than or equal to Hover root three (i.e., $L \geq H/\sqrt{3}$) where H is the distance between the top end of the center electrode 4 and the top end of the metal shell 2 in the axial direction of the spark plug 1. This reduces the required voltage at the spark plug 1.

The thickness t of the inner top end 211 in the axial direction of the spark plug 1 and the diameter D of the top end of the center electrode 4 are so selected as to meet a relation of $t \leq D$, thereby also reducing the required voltage at the spark plug 1.

FIGS. 6 to 9 illustrate the spark plug 1 of the second embodiment. The same reference numbers as employed in the first embodiment will refer to the same parts, and explanation thereof in detail will be omitted here.

The inward top end protrusion 21 of this embodiment does not extend continuously over the whole of the circumference of the top end of the metal shell 2. In other words, the inward top end protrusion 21 is formed only on a portion of the top end of the metal shell 2.

Figure 6:
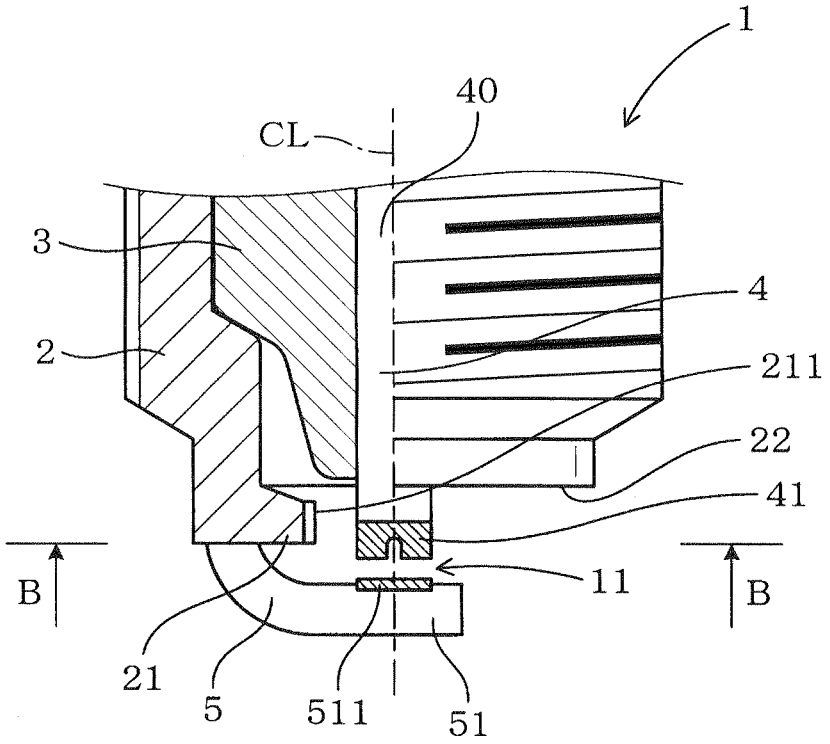
FIG. 6 is a partially longitudinal sectional view which shows a spark plug according to the second embodiment.
Figure 7:
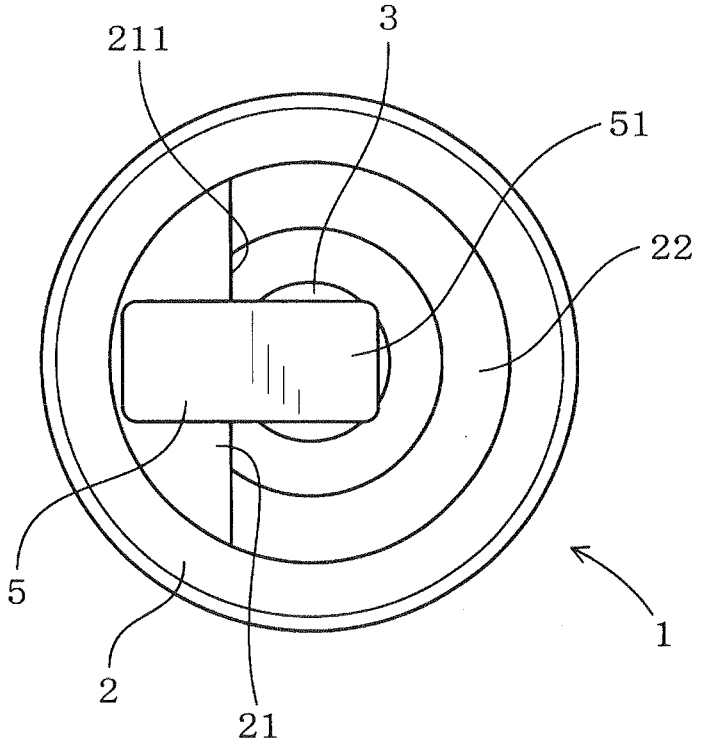
FIG. 7 is a top view of FIG. 6.
Figure 8:
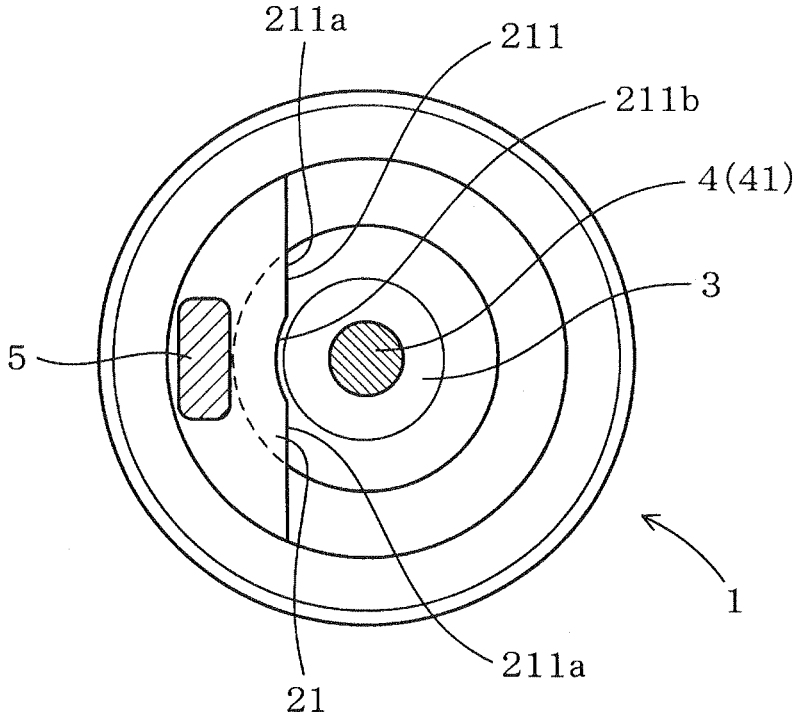
FIG. 8 is a partially traverse sectional view, as taken along the line B-B in FIG. 6.

Specifically, the inward top end protrusion 21 is, as clearly illustrated in FIGS. 6 and 7, formed on the top end of the metal shell 2 on the same side of the end of the ground electrode 5 welded to the metal shell 2. The inner top end 211 (i.e., an inside end surface) of the inward top end protrusion 21, as illustrated in FIG. 8, includes straight-shaped portions 211*a* and an arc-shaped portion 211*b* between the straight-shaped portions 211*a*. The straight-shaped portions 211*a* and the arc-shaped portion 211*b* define the inside end surface of the inward top end protrusion 21. The straight-shaped portions 211*a* are aligned with each other and extend perpendicular to the longitudinal direction of the center electrode-facing portion 51 of the ground electrode 5, as viewed from the top end of the spark plug 1 in the axial direction thereof. The center electrode-facing portion 51, as described above, extend substantially perpendicular to the longitudinal center line CL of the spark plug 1, as illustrated in FIG. 6. The arc-shaped portion 211*b*, as can be seen from FIG. 8, has an inward facing surface contoured to conform with the outer periphery of the center electrode 3. In other words, the inward facing surface is curved to have substantially the same radius of curvature as that of the center electrode 3.

Figure 9:
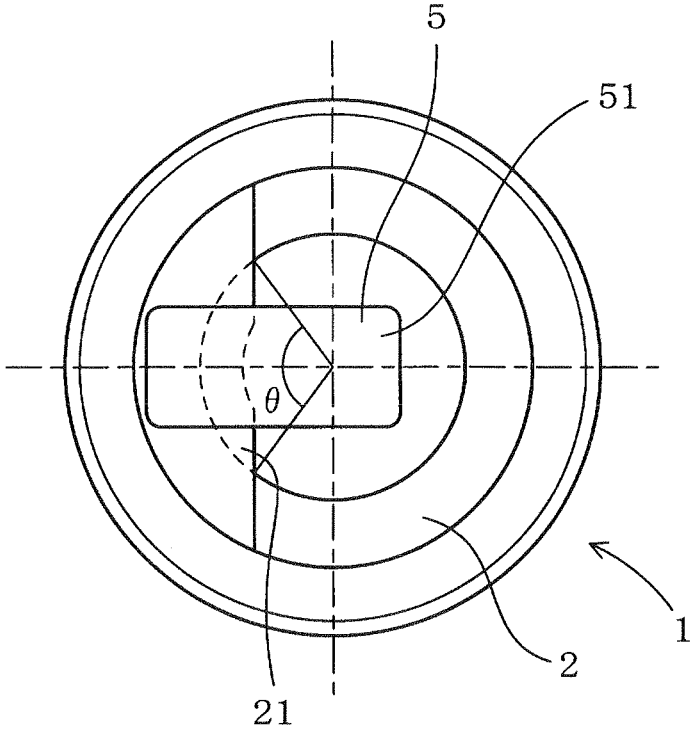
FIG. 9 is a side view which shows a configuration of an inward top end protrusion of the spark plug of FIG. 6.

The inward top end protrusion 21 occupies a portion of a circumference of the spark plug 1 (i.e., the metal shell 2) which is 90° or more with respect to the center of the spark plug 1. In other words, the inward top end protrusion 21 is formed over a range of 90° or more in the circumferential direction of the spark plug 1. Specifically, the angle θ, as illustrated in FIG. 9, which lines extending from the central axis of the spark plug 1 (i.e., the metal shell 2) to outermost circumferential ends of the inward top end protrusion 21 at an inner edge of the top end of the metal shell 2 leading to the inner surface of the inward top end protrusion 21 make with each other (i.e., intersections of the surface of the inward top end protrusion 21 with the inner edge of the top end of the metal shell 2) is 120° on a plane extending perpendicular to the length of the spark plug 1 (i.e., the metal shell 2).

The inward top end protrusion 21 also projects from a major portion of the top of the metal shell 2 in the axial direction of the metal shell 2. In other words, the metal shell 2, as illustrated in FIG. 6, has a top end surface 22 which occupies a major part of the circumference of the top of the metal shell 2 and is lower in level than the inward top end protrusion 21 toward the base end of the spark plug 1 (i.e., the upper end of the spark plug 1, as viewed in FIG. 4).

Other arrangements are identical with those in the first embodiment, and explanation thereof in detail will be omitted here.

The inward top end protrusion 21, like the first embodiment, serves to lower the flame quenching property of the metal shell 2 to improve the ignition ability of the spark plug 1.

Figure 10:
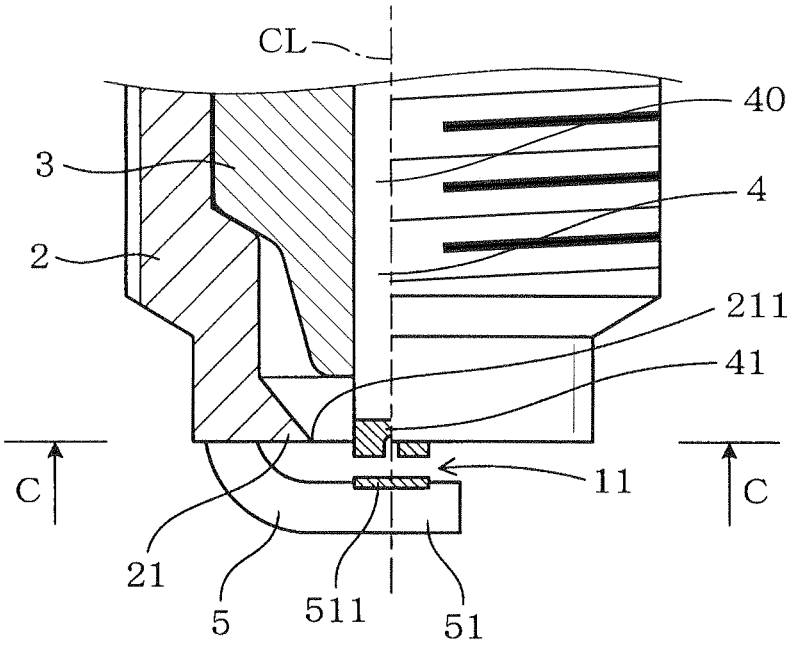
FIG. 10 is a partially longitudinal sectional view which shows a spark plug according to the third embodiment.
Figure 11:
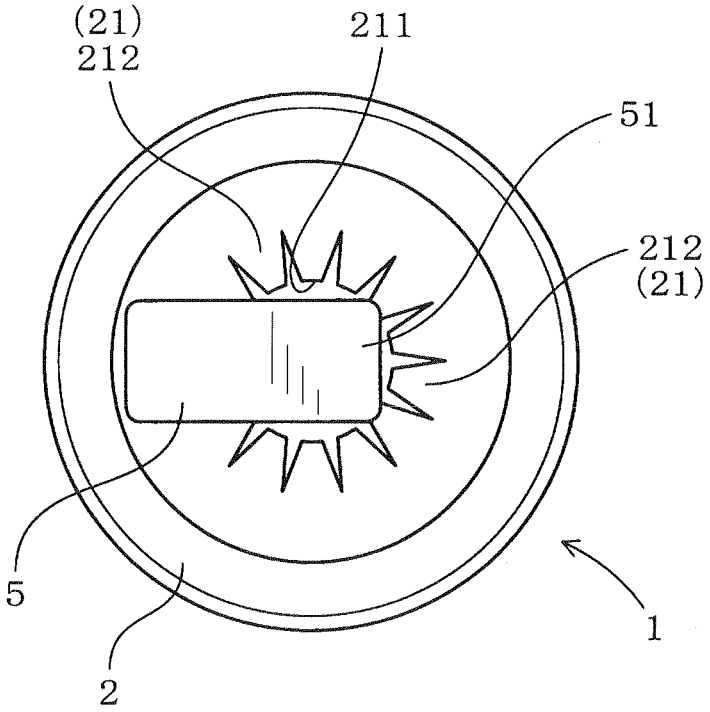
FIG. 11 is a top view which illustrates a first modified structure of a spark plug of the third embodiment.
Figure 12:
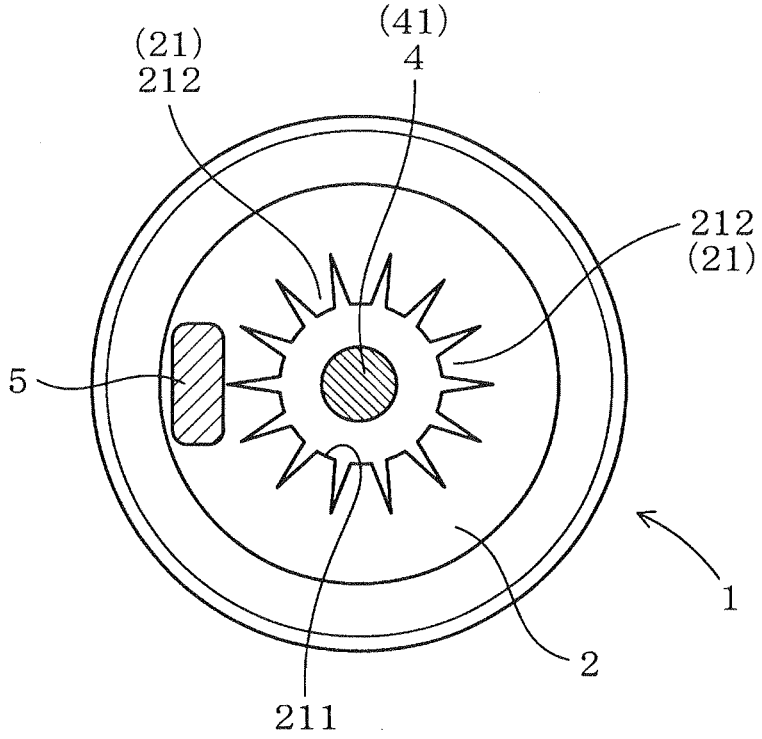
FIG. 12 is a top view which illustrates a second modified structure of a spark plug of the third embodiment.

FIGS. 10 to 12 illustrate the spark plug 1 of the third embodiment. The same reference numbers as employed in the first embodiment will refer to the same parts, and explanation thereof in detail will be omitted here.

The inward top end protrusion 21, like in the first embodiment, extends continuously over the whole of the circumference of the top end of the metal shell 2. The inward top end protrusion 21 has a plurality of inward-oriented trapezoidal projections 212 arrayed in a circle.

The inward projections 212 are formed adjacent each other over the entire circumference of the inner end of the inward top end protrusion 21 so that a wedge-shaped slit is defined between every adjacent two of the inward projections 212.

The inward top end protrusion 21, as clearly illustrated in FIG. 10, has the inner top end 211 with a sharp edge. In other words, the inner top end 211 has an acute-angled edge, as viewed on a plane extending along the longitudinal center line CL of the spark plug 1.

Other arrangements are identical with those in the first embodiment, and explanation thereof in detail will be omitted here.

The inward top end protrusion 21 offers the same effects as those in the first embodiment.

Figure 13:
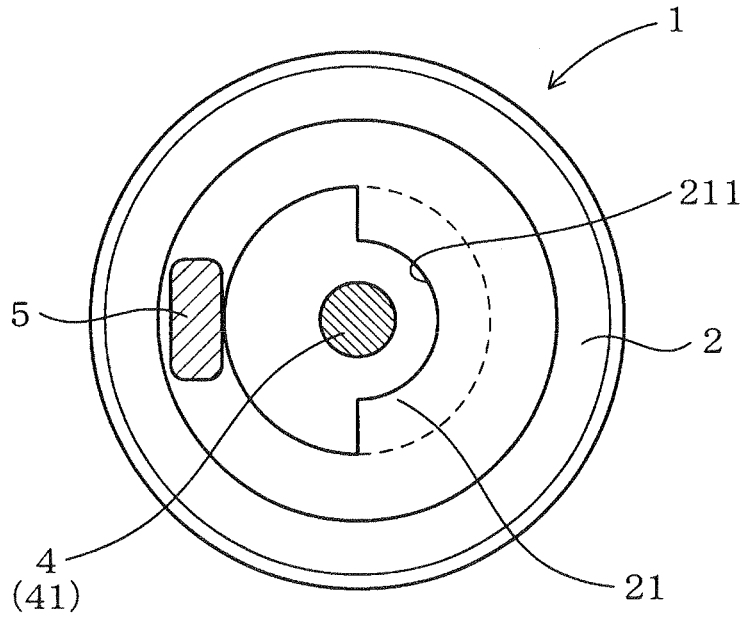
FIG. 13 is a top view which illustrates a spark plug of the fourth embodiment.
Figure 14:
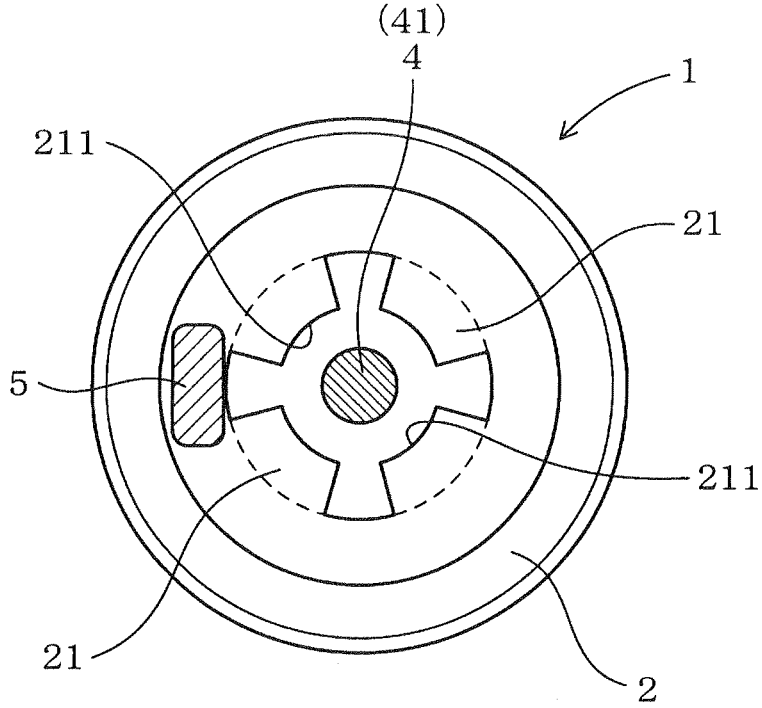
FIG. 14 is a top view which illustrates a first modification of the spark plug of the fourth embodiment.
Figure 15:
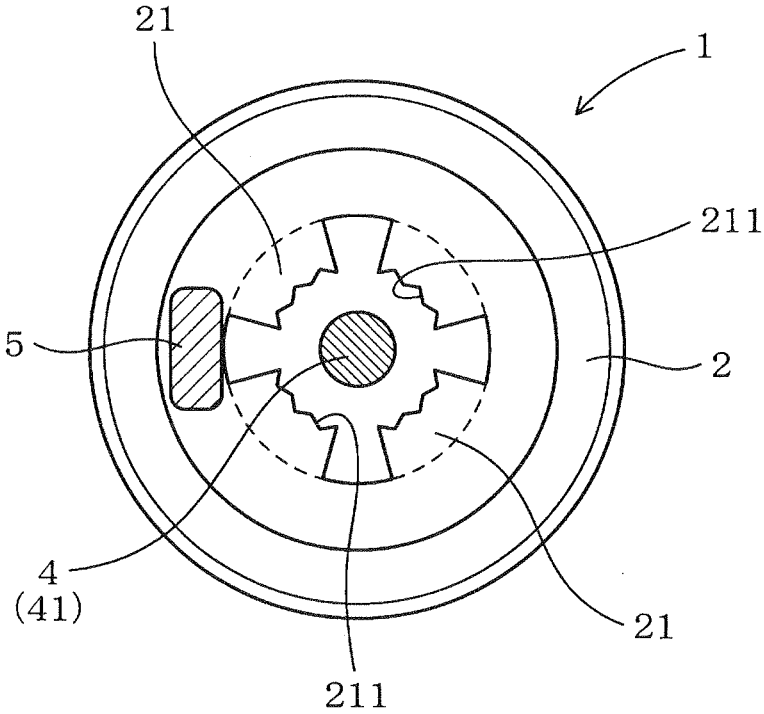
FIG. 15 is a top view which illustrates a second modification of the spark plug of the fourth embodiment.

FIGS. 13 to 15 illustrate the spark plug 1 of the fourth embodiment. The same reference numbers as employed in the first embodiment will refer to the same parts, and explanation thereof in detail will be omitted here.

The inward top end protrusion 21 of this embodiment occupies a half of the circumference of the top end of the metal shell 2 and is diametrically opposed to the joint of the ground electrode 5 to the metal shell 2.

FIG. 14 illustrates a first modification of the spark plug 1 of FIG. 13. The inward top end protrusion 21 of this modification is defined by four discrete trapezoidal blocks which are arranged at regular intervals in the circumferential direction of the meta shell 2.

FIG. 15 illustrates a second modification of the spark plug 1 of FIG. 13. The inward top end protrusion 21 of this modification is, like in the first modification of FIG. 14, defined by four discrete trapezoidal blocks which are arranged at regular intervals in the circumferential direction of the meta shell 2. Each of the trapezoidal blocks has an uneven or irregular inward surface which defines a portion of the inner top end 211.

Other arrangements are identical with those in the first embodiment, and explanation thereof in detail will be omitted here. Each of the blocks of the inward top end protrusion 21 in each of the first and second modifications may alternatively be designed to have another shape.

The inward top end protrusion 21 of the fifth embodiment offers the same effects as those in the first embodiment.

Test Example 1

Figure 17:
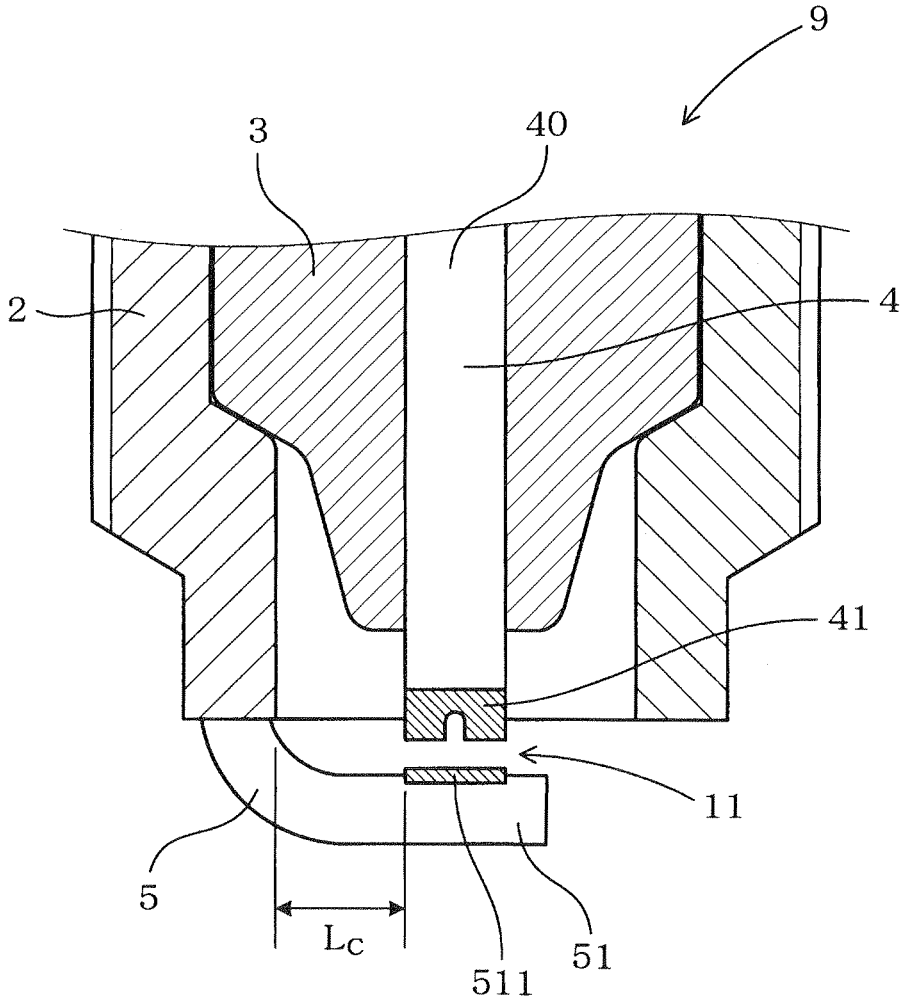
FIG. 17 is a partially longitudinal sectional view which shows a comparative spark plug used in the first tests of FIG. 16.

We performed tests on samples of the spark plug 1 of FIG. 1 and a comparative spark plug 9, as illustrated in FIG. 17, which does not have the inward top end protrusion 21 to evaluate a difference in required voltage between the spark plugs 1 and 9. In FIG. 17, the same reference numbers as employed in the first embodiment will refer to similar parts.

The samples of the spark plug 1 used in the tests each have the following dimensions. L=2 mm. t=1 mm. D=2 mm. H=0.5 mm. These characters are the same as those described in FIG. 5.

The samples of the spark plug 9 each have the structure, as illustrated in FIG. 17. The distance Lc between an inner edge of the top end of the metal shell 2 and the periphery of the center electrode 4 is 4 mm. Other dimensions are identical with those of the spark plug 1.

The samples of each of the spark plugs 1 and 9 have different sizes G of the spark gap 11 which range from 0.2 mm to 1.4 mm in increments of 0.2 mm.

We measured values of voltage required by the samples to create a spark. Specifically, we mounted each sample in a test container filled with a sulfur hexafluoride (SF6) gas at 0.4 MPa and measured the required voltage at the sample. More specifically, we applied voltage to each sample to produce an electric discharge 120 times at 30 Hz, measured the voltage required by the sample to produce each electric discharge, and determined an average of the 120 voltages as the required voltage.

Figure 16:
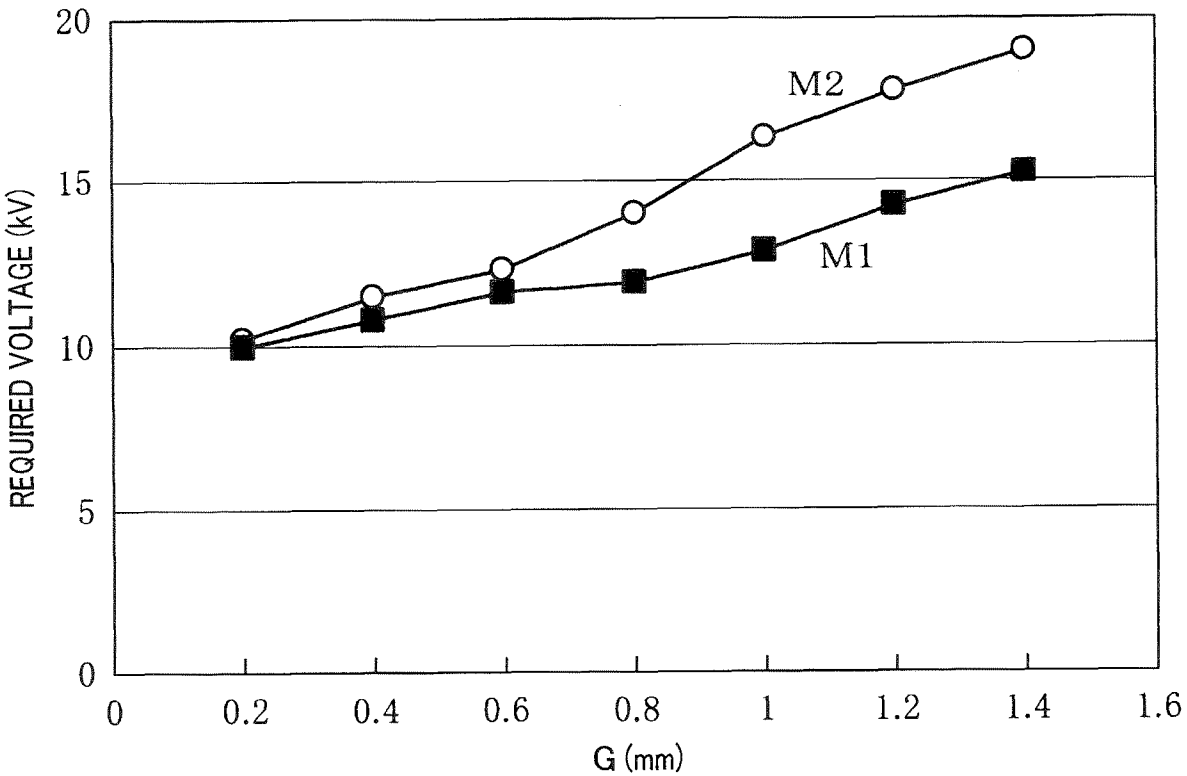
FIG. 16 is a graph which represents results of first tests to evaluate a relation between a size of a spark gap of a spark plug and a required voltage at the spark plug.

FIG. 16 is a graph which represents results of the tests on the samples. A line M1 indicates the results on the samples of the spark plug 1. A line M2 indicates the results on the samples of the spark plug 9.

The graph shows that the required voltage at the spark plug 1 of the first embodiment is lower than that at the spark plug 9, that is, that the inward top end protrusion 21 serves to lower the voltage required by the spark plug 1 to create an electric spark. The graph also shows that especially, when the size G of the spark gap 11 is 0.8 mm or more, a difference in the required voltage between the spark plug 1 and the spark plug 9 increases because when the size G is 0.6 mm or less, the required voltage is originally low. Too small a value of the size G, however, results in a drop in ignitability of the air-fuel mixture in the engine. It is, thus, essential to decrease the required voltage without too small a value of the size G of the spark gap 11. The structure of the spark plug 1, therefore, has been found to meet all such requirements.

Test Example 2

Figure 18:
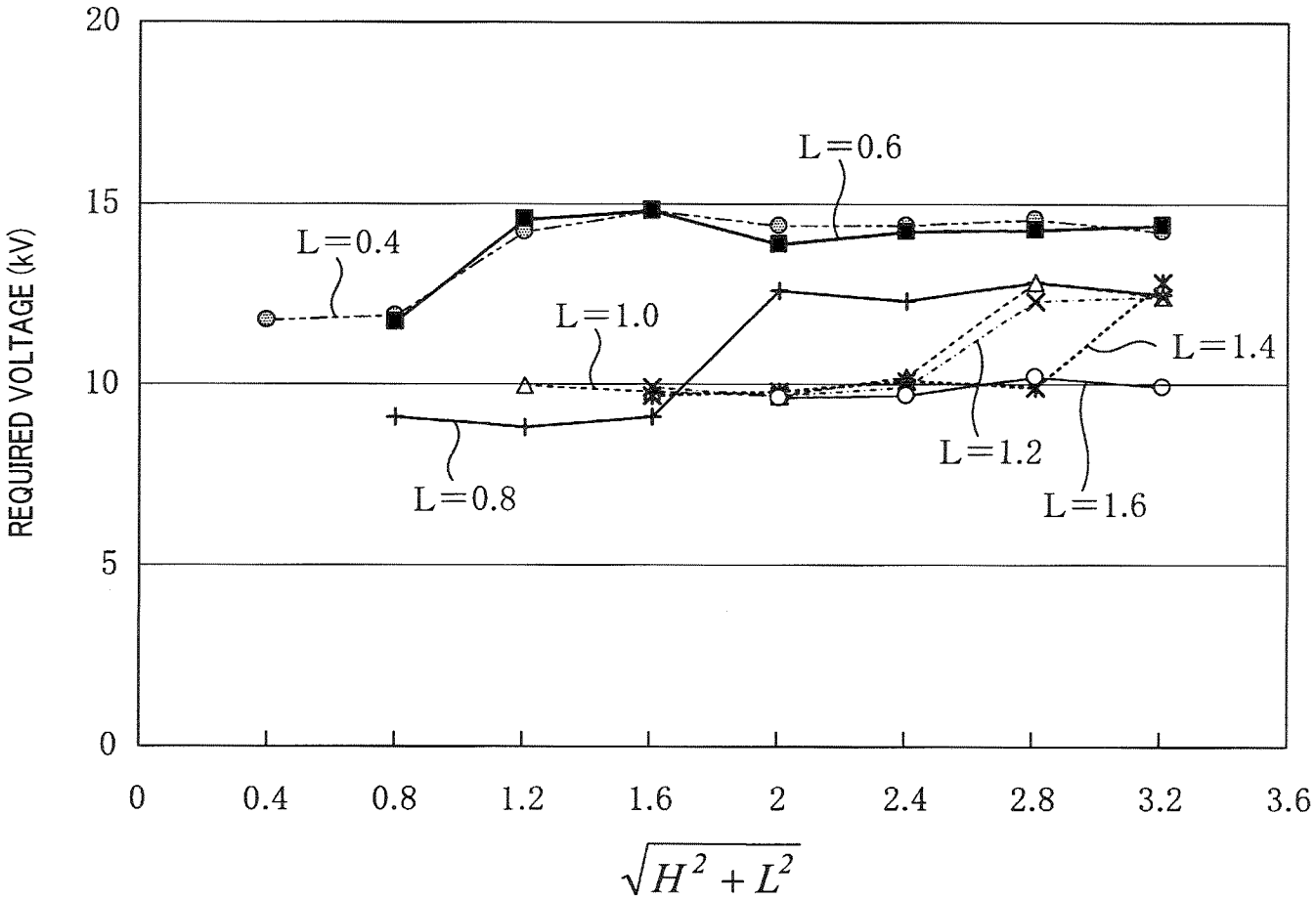
FIG. 18 is a graph which represents results of second tests to analyze effects of a relation between a minimum distance between a top corner of an inner top end of an inward top end protrusion and a top end corner of a center electrode and a distance between the inner top end of the inward top end protrusion and a periphery of the center electrode on a required voltage at a spark plug.

We also performed tests, as illustrated in FIG. 18, to analyze effects of a relation between a minimum distance between the top corner 214, as illustrated in FIG. 5, of the inner top end 211 of the inward top end protrusion 21 and the top end corner 411 of the center electrode 4 and the distance L between the inner top end 211 of the inward top end protrusion 21 and the periphery of the center electrode 4 on the required voltage at the spark plug 1.

The minimum distance between the top corner 214 of the inner top end 211 of the inward top end protrusion 21 and the top end corner 411 of the center electrode 4 is expressed by $(H^2+L^2)^{1/2}$ where H and L are the dimensions as already described in FIG. 5.

We prepared samples of the spark plug 1 which are different in value of $(H^2+L^2)^{1/2}$ from each other. Each sample has the following dimensions: G=0.3 mm, t=1 mm, and D=2 mm. We performed the tests on the samples to measure the required voltages in the same way, as described in TEST EXAMPLE 1. The results of the tests are shown in a graph of FIG. 18. The horizontal axis indicates $(H^2+L^2)^{1/2}$. Each line is defined by connecting the results of the tests on the samples whose distance L is the same. The unit of L is millimeters. For example, "L=0.4" represents the distance L=0.4 mm.

The graph shows that when $(H^2+L^2)^{1/2}$ is smaller than or equal to 2 L, it results in a great decrease in the required voltage at the samples. Rewriting $(H^2+L^2)^{1/2} \leq 2L$, we obtain $L \geq H/\sqrt{3}$. It is, thus, found that the lowering of the required voltage is achieved by designing the spark plug 1 to meet a relation of $L \geq H/\sqrt{3}$. This is because the strength of an electric field is enhanced particularly in a region of 2 L or less from the inward top end protrusion 21, so that the lowering of the voltage required to create a spark in the spark gap 11 may be achieved by locating the top end of the center electrode 4 defining the spark gap 11 within the above region.

Test Example 3

Figure 19:
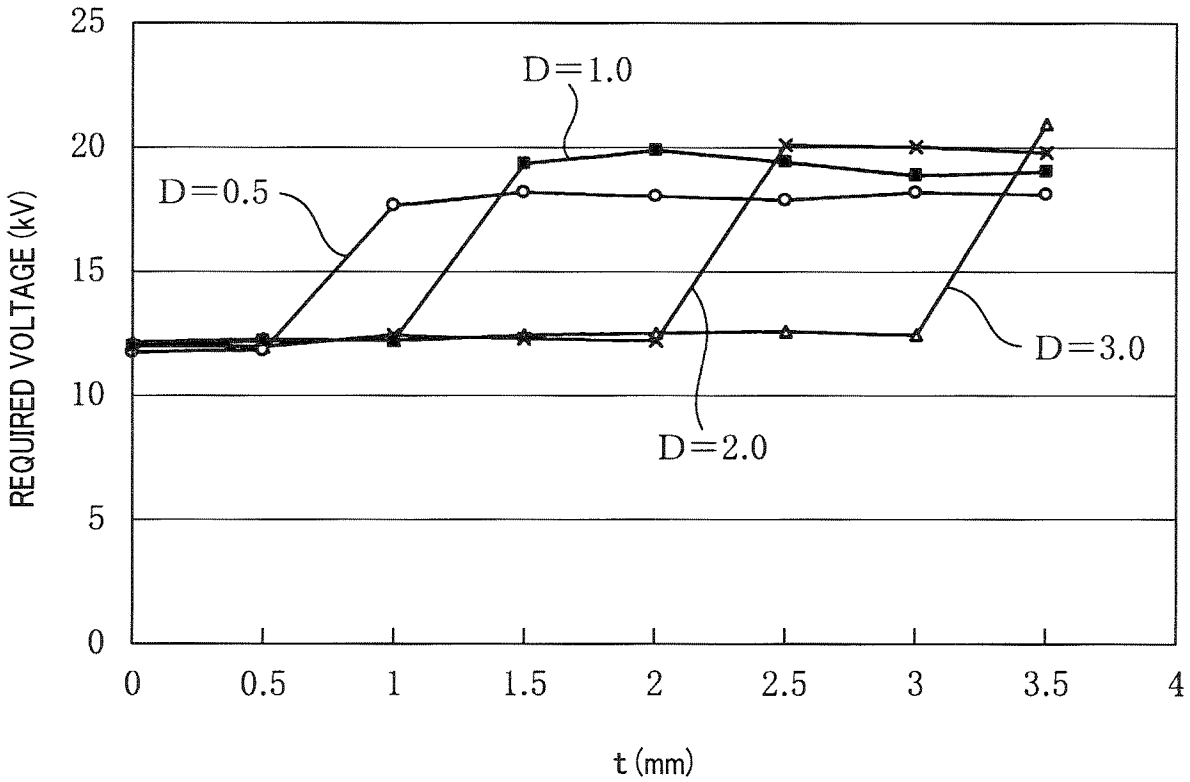
FIG. 19 is a graph which represents results of third tests to analyze effects of a relation between a thickness of an inner top end of an inward top end protrusion and a diameter of a top end of a center electrode on a required voltage at a spark plug.

We also performed tests, as illustrated in FIG. 19, to analyze effects of a relation between the thickness t of the inner top end 211, as defined in the axial direction of the spark plug 1, and the diameter D of the top end of the center electrode 4 (i.e., the noble metal chip 41) on the required voltage at the spark plug 1.

We prepared samples of the spark plug 1 which have the following dimensions: G=0.4 mm, L=2 mm, and H=1 mm. The samples also have different values of the diameter D which are 0.5 mm, 1.0 mm, 2.0 mm, and 3.0 mm and different values of the thickness t. The characters G, L, H, D, and t represent the same dimensions as described in FIG. 5.

We performed the tests on the samples to measure the required voltages in the same way, as described in TEST EXAMPLE 1. The results of the tests are shown in a graph of FIG. 19. Each line is defined by connecting the results of the tests on the samples whose diameter D is the same. The unit of D is millimeter. For example, "D=0.5" represents the distance D=0.5 mm. The samples whose thickness t is zero millimeter have the inward top end protrusion 21 with the sharp-edged inner top end 211, as illustrated in FIG. 10.

The graph shows that when the thickness t is smaller than or equal to the diameter D (i.e., $t \leq D$), the required voltage at the samples is lowered. It is, thus, found that the lowering of the required voltage is achieved by designing the spark plug 1 to have the thickness t of the inner top end 211 smaller than or equal to the diameter D of the top end of the center electrode 4. This is because the strength of an electric field in the spark gap 11 is thought of as being enhanced by decreasing the thickness t of the inner top end 211 of the inward top end protrusion 21, so that the strength of an electric field between the inward top end protrusion 21 and the center electrode 4 is increased.

Test Example 4

Figure 20:
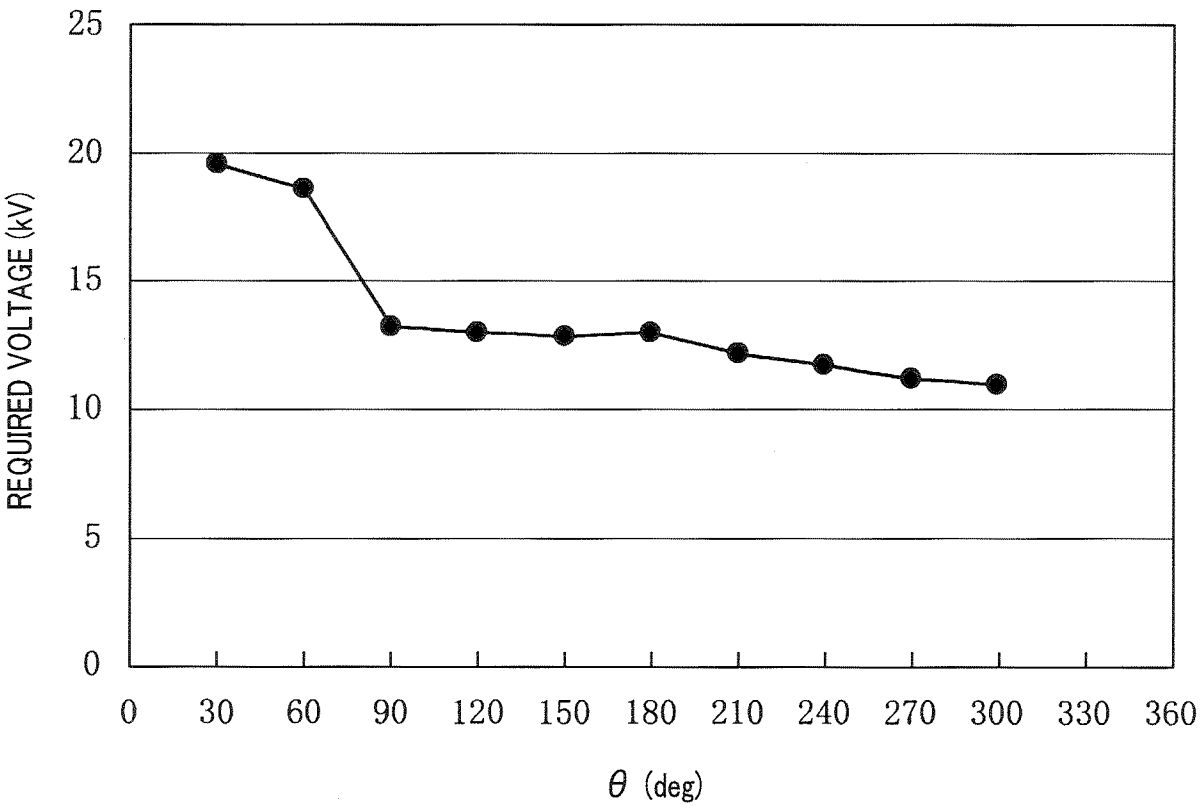
FIG. 20 is a graph which illustrates results of fourth tests to analyze effects of a structure of a spark plug, as illustrated in FIGS. 6 to 9, on a required voltage at the spark plug.

We also performed tests, as illustrated in FIG. 20, to analyze effects of the structure of the spark plug 1, as illustrated in FIGS. 6 to 9, in which the inward top end protrusion 21 is formed only on the portion of the top end of the metal shell 2 on the required voltage. Specifically, we measured a relation between the angle θ, as illustrated in FIG. 9, which the lines extending from the central axis of the spark plug 1 to the circumferential ends of the inward top end protrusion 21 at the inner edge of the top end of the metal shell 2 make with each other and the voltage required by the spark plug 1 to create a spark.

Figure 21A:
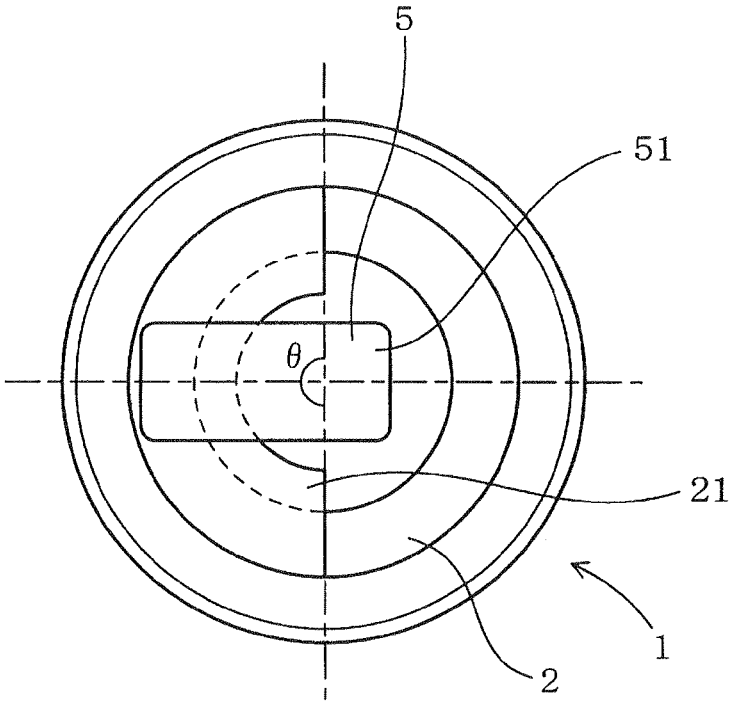
FIG. 21(*a*) is a top view which illustrates a test sample of a spark plug of the second embodiment.
Figure 21B:
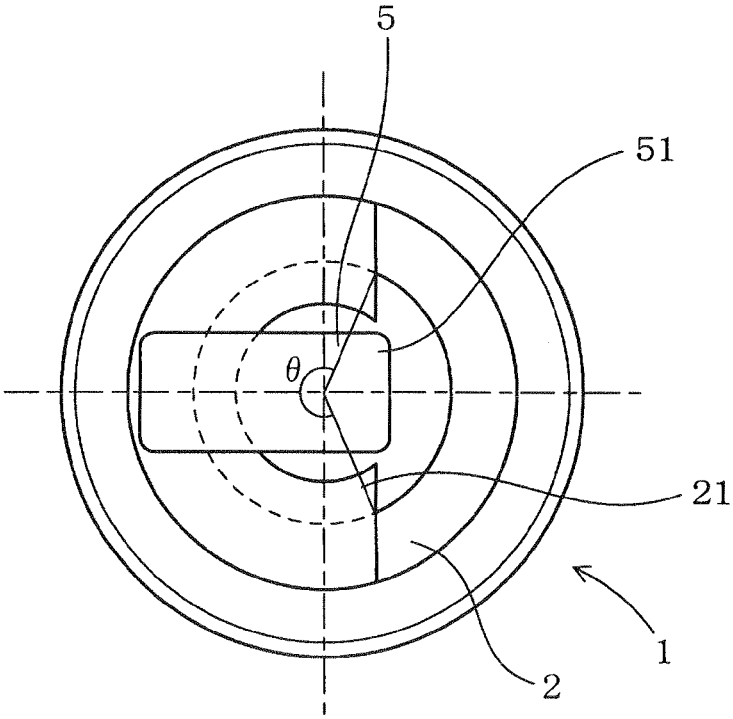

We prepared samples of the spark plug 1 of the second embodiment which are different in angle θ from each other in a range of 30° to 300°. We performed the tests on the samples to measure the required voltages in the same way, as described in TEST EXAMPLE 1. The results of the tests are shown in a graph of FIG. 20. The samples other than those in which the angle θ is, like in FIG. 9, less than 90° and more than 0° are, as illustrated in FIGS. 21(*a*) and 12(*b*), 180° and 240° in angle θ.

The graph shows that when the angle θ is 90° or more, the required voltage drops greatly. It is, therefore, found that the inward top end protrusion 21 is preferably so formed as to occupy 90° or more of the circumference of the spark plug 1.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For instance, the center electrode 4 and the ground electrode 5 of the spark plug 1 of each embodiment may alternatively designed not to have the noble metal chips 41 and 511. In this case, the top end of the center electrode 4 and a portion of the center electrode-facing portion 51 of the ground electrode 5 which faces the spark gap 11 may be made of a low durability material such as a nickel alloy. The use of such a material leads to a concern about a decrease in service life of the spark plug 1, but however, the inward top end protrusion 21 serves to enhance the strength of an electric field around the center electrode 4, thus compensating for such a decrease in service life of the spark plug 1.

What is claimed is:

1. A spark plug for an internal combustion engine comprising:

a hollow cylindrical housing with a top end facing a top of the spark plug;

a cylindrical porcelain insulator which is retained in the cylindrical housing;

a center electrode which is retained in the porcelain insulator with a top thereof exposed outside a top end of the porcelain insulator; and a ground electrode which is joined to the cylindrical housing so as to form a spark gap between itself and the top of the center electrode;

wherein the hollow cylindrical housing includes an inward top end protrusion which extends inwardly from the top end of the cylindrical housing, the inward top end protrusion being at least partially located to be closer to the top of the spark plug than the top end of the porcelain insulator is in an axial direction of the spark plug;

wherein a distance L between the inward top end protrusion and the center electrode and a size G of the spark gap in the axial direction of the spark plug are so selected as to meet a relation of $G<L$;

wherein the hollow cylindrical housing includes a retaining portion which retains the cylindrical porcelain therein and the inward top end protrusion which extends from the retaining portion inwardly in a radial direction of the spark plug toward a side surface of the center electrode; and wherein the center electrode has a top end surface in an axial direction of the spark plug, the top end being located outside the inward top end protrusion in the axial direction of the spark plug.

2. A spark plug as set forth in claim 1, wherein the distance L and the size G of the spark gap are so selected as to satisfy a relation of $G+0.5\ \text{mm}<L$.

3. A spark plug as set forth in claim 1, wherein the top of the center electrode extends outside the top end of the cylindrical housing toward the top of the spark plug.

4. A spark plug as set forth in claim 3, wherein the distance L between the inward top end protrusion and the center electrode is set greater than or equal to H over root three where H is a distance between the top of the center electrode and the top end of the cylindrical housing in the axial direction of the spark plug.

5. A spark plug as set forth in claim 1, wherein a thickness t of an inner top end of the inward top end protrusion, as defined in the axial direction of the spark plug, and a diameter D of the top of the center electrode are so provided as to meet a relation of $t \leq D$.

6. A spark plug as set forth in claim 1, wherein the inward top end protrusion is formed across a range of 90° or more in a circumferential direction of the spark plug.

* * * * *